US009047726B2

(12) United States Patent
Petermann et al.

(10) Patent No.: US 9,047,726 B2
(45) Date of Patent: Jun. 2, 2015

(54) METHOD FOR SEPARATING A STACK OF VALUE DOCUMENTS

(75) Inventors: Udo Petermann, Altenbeken (DE); Paul Freitag, Steinheim (DE); Richard Duesterhus, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/985,830

(22) PCT Filed: Feb. 16, 2012

(86) PCT No.: PCT/EP2012/052657

§ 371 (c)(1),
(2), (4) Date: Sep. 9, 2013

(87) PCT Pub. No.: WO2012/110584

PCT Pub. Date: Aug. 23, 2012

(65) Prior Publication Data

US 2013/0341850 A1 Dec. 26, 2013

(30) Foreign Application Priority Data

Feb. 17, 2011 (DE) ..... 10 2011 000 794

(51) Int. Cl.
*B65H 5/00* (2006.01)
*G07D 11/00* (2006.01)
*B65H 3/52* (2006.01)

(52) U.S. Cl.
CPC ..... *G07D 11/0024* (2013.01); *B65H 3/5284* (2013.01); *B65H 2511/30* (2013.01); *B65H 2701/1311* (2013.01); *B65H 2701/1912* (2013.01); *G07D 11/0021* (2013.01)

(58) Field of Classification Search
CPC ..... B65H 3/5261; B65H 7/12; B65H 7/125; B65H 3/5284; B65H 2511/30; B65H 2701/1311; B65H 2701/1912; G07D 11/0024; G07D 11/0021
USPC ..... 271/10.03, 110, 111, 122, 262, 263
See application file for complete search history.

(56) References Cited

U.S. PATENT DOCUMENTS 4,159,782 A * 7/1979 Swartzendruber ..... 221/1
6,224,049 B1 5/2001 Hosking et al.

(Continued)

FOREIGN PATENT DOCUMENTS

DE 10105521 A1 8/2002
DE 10203176 B4 9/2004

(Continued)

OTHER PUBLICATIONS

International Preliminary Report on Patentability for PCT/EP2012/052657 mailed Aug. 29, 2013 with English translation (18 pages).

(Continued)

*Primary Examiner* — Jeremy R Severson
(74) *Attorney, Agent, or Firm* — Harness, Dickey & Pierce, P.L.C.

(57) ABSTRACT

The invention concerns a method for separating a stack of notes of value, in which the stack of notes of value is arranged in a separating position. Subsequently, a withdrawal element is driven such that it transports at least one marginal note of value of the stack of notes of value in a separating direction in the direction of a separating gap formed between a transport element and a counter run element. Also the transport element is driven such that it transports the note of value further in the separating direction. By means of a sensor unit arranged downstream of the separating gap the number of the notes of value withdrawn and transported through the separating gap is determined. The withdrawal element, the transport element and/or the counter run element are controlled depending on this determined number of notes of value withdrawn.

13 Claims, 4 Drawing Sheets

(56) References Cited

U.S. PATENT DOCUMENTS

| | | | | |
|---|---|---|---|---|
| 7,537,213 | B2 | 5/2009 | Chang et al. | |
| 7,552,924 | B2 * | 6/2009 | Sano et al. | 271/263 |
| 7,556,259 | B2 | 7/2009 | Graef et al. | |
| 7,726,645 | B2 * | 6/2010 | Gerlier et al. | 271/122 |
| 7,950,649 | B2 * | 5/2011 | Katsura et al. | 271/10.03 |
| 7,954,816 | B2 | 6/2011 | Freitag et al. | |
| 8,340,391 | B2 | 12/2012 | Petermann | |
| 2004/0188916 | A1 * | 9/2004 | Tsukamoto et al. | 271/110 |
| 2007/0210506 | A1 * | 9/2007 | Mitsuya et al. | 271/110 |
| 2008/0073834 | A1 * | 3/2008 | Chang et al. | 271/262 |
| 2009/0160119 | A1 * | 6/2009 | Komuro | 271/10.11 |
| 2010/0213023 | A1 | 8/2010 | Freitag et al. | |
| 2012/0211935 | A1 | 8/2012 | Petermann et al. | |
| 2013/0099439 | A1 | 4/2013 | Duesterhus | |

FOREIGN PATENT DOCUMENTS

| | | | |
|---|---|---|---|
| DE | 10-2009-021320 | A1 | 11/2010 |
| EP | 0949171 | A1 | 10/1999 |
| EP | 2251286 | A2 | 11/2010 |
| WO | WO-2005-041135 | A1 | 5/2005 |

OTHER PUBLICATIONS

English Translation of the Written Opinion of the ISA for PCT/EP2012/052657, mailed May 22, 2012; ISA/EP.

* cited by examiner

METHOD FOR SEPARATING A STACK OF VALUE DOCUMENTS

CROSS-REFERENCE TO RELATED APPLICATIONS

This application is a National Stage of International Application No. PCT/EP2012/052657, filed Feb. 16, 2012, and published in German as WO 2012/110584 A1 on Aug. 23, 2012. This application claims the benefit and priority of German Application No. 10 2011 000 794.6, filed Feb. 17, 2011. The entire disclosures of the above applications are incorporated herein by reference.

BACKGROUND

This section provides background information related to the present disclosure which is not necessarily prior art.

TECHNICAL FIELD

The invention concerns a method for separating a stack of notes of value, wherein the stack of notes of value is arranged in a separating position and wherein a withdrawal element is driven such that the withdrawal element transports at least one note of value of the stack of notes of value being in contact with the withdrawal element in a separating direction in the direction of a separating gap formed between a transport element and a counter run element.

DISCUSSION

The device in particular is an automatic cash safe, an automatic cash system and/or an automated teller machine, such as a cash deposit machine for depositing banknotes and checks. The notes of value are entered in the form of a stack of notes of value by an operator via an input and/or output compartment. In order to further process the notes of value, in particular in order to capture the respective denomination of banknotes and/or the amount of checks and to deposit the notes of value in value note cassettes, it is necessary that the notes of value of the stack of notes of value are separated.

To this end, in known methods the transport element is driven such that it transports the notes of value in the separating direction, and the counter run element is driven such that it transports a note of value in contact therewith opposite to this separating direction or retains the note of value, respectively. This aims at preventing a plurality of notes of value, that at least partially overlap one another, from being transported through the separating gap. Such method and such device for separating notes of value is for example known from document DE 10203176 B4.

What is problematic about the known methods is that, in particular where stacks of notes of value including different notes of value are to be separated, this rigid constant control of the individual elements of the separating unit may result in multiple withdrawals, faulty withdrawals and/or flags. The term multiple withdrawal means that a plurality of notes of value sticking to one another are jointly transported through the separating gap. The term faulty withdrawal means that no note of value at all is withdrawn from the stack of notes of value even though this was intended. The term flags means that there is a plurality of notes of value partially overlapping one another and/or being consecutively withdrawn with an only very small distance, smaller than a preset minimum distance, such that in the further transport, this distance between the notes of value is not sufficient for correctly processing them.

SUMMARY OF THE INVENTION

It is an object of the invention to specify a method for separating a stack of notes of value, by means of which a separation of the notes of value of the stack of notes of value is easily and reliably achieved.

According to the invention, a sensor unit is arranged downstream of the separating gap at a monitoring position, which determines the number of notes of value withdrawn from the stack of notes of value and transported through the separating gap. In this way, it can easily be determined whether a multiple withdrawal, a faulty withdrawal or an intended withdrawal of only one note of value takes place. Depending on the number determined, the withdrawal element, the transport element and/or the counter run element are controlled. Herein, the withdrawal element, the transport element and/or the counter run element are particularly controlled such that in the case of a multiple withdrawal, all but one of the notes of value are transported back, such that now only one note of value is transported further as specified, that in the case of a faulty withdrawal it is achieved that exactly one note of value can be withdrawn, and that in the case of an intended withdrawal of one single note of value, such note of value is transportable further in the separating direction.

Determining the number of notes of value particularly means that it is determined whether no note of value, exactly one note of value or more than one note of value has been withdrawn. It is not inevitably required that, when determining that a plurality of notes of value has been withdrawn (multiple withdrawal), the exact number of such notes of value is detected.

The counter run element is particularly not driven until the front edge, as viewed in the separating direction, of the note of value withdrawn has reached the monitoring position. Thus, until the monitoring position is reached, the note of value withdrawn is transported only through the transport element and the withdrawal element in the separating direction, wherein such transport is not obstructed by the counter run element. Thus, in particular, the transport of the note of value withdrawn is not slowed-down such that it is prevented that flags occur.

The withdrawal element, the counter run element and the transport element each preferably have a shaft on each of which a plurality of rollers are stationarily and non-rotatably arranged. The shafts are particularly driven via a central drive unit, wherein the drive direction of the shafts and consequently the drive direction of the elements can be varied.

In a preferred embodiment of the method, the notes of value are transported along a transport path while the procedural steps are carried out. The withdrawal element and the transport element are arranged on a first side of the transport path and, for transport of the notes of value in the separating direction, are rotated in a separating rotational direction. The counter run element is arranged on the second side of the transport path opposing the first side.

In particular, a sensor unit is used comprising a first sensor and a second sensor arranged downstream of the first sensor. By means of the first sensor it is determined whether at all at least one note of value has been withdrawn and transported through the separating gap, wherein the second sensor is used to determine whether one note of value or more than one note of value has been withdrawn. By means of the second sensor in particular the number of the notes of value withdrawn is determined.

The first sensor particularly comprises a light barrier, wherein upon interruption of the light beam of the light barrier, the withdrawal of at least one note of value is detected. The second sensor preferably has an ultrasonic sensor by means of which the number of the notes of value withdrawn is detectable. By means of the ultrasonic sensor, in the case of a multiple withdrawal, particularly the air present between notes of value jointly withdrawn and lying on top of each other is detected, which air can then be used to detect the withdrawal of a plurality of notes of value. In an alternative embodiment of the invention, the ultrasonic sensor can additionally or alternatively be used to determine the thickness of the notes of value jointly withdrawn, wherein this consequently can serve to determine whether one note of value or a plurality of notes of value has been withdrawn.

In a preferred embodiment of the invention, the withdrawal element is stopped when the first sensor has determined that at least one note of value is present. Thus, the note of value is transported in the separating direction then only by means of the transport element, such that it is prevented that a further note of value is withdrawn, wherein it is particularly prevented that flags occur as the withdrawal element is not driven any more.

If by means of the sensor unit it has been determined that exactly one note of value has been withdrawn, advantageously the transport element is driven further such that the note of value is transported further in the separating direction in the direction of a further transport element. The transport element is stopped when the further transport element contacts the note of value such that the note of value is moved further in the separating direction now only by the further transport element. By stopping the transport element, such transport element jointly with the counter run element retains further notes of value such that in this way, running-in of further notes of value into the separating gap is prevented. In this way occurrence of flags is prevented.

The further transport element can particularly comprise two driven rollers, wherein the note of value is transported into a gap formed between the two rollers. The rollers contact the note of value arranged in the gap and transport it further in the separating direction. By means of a further sensor, in particular a light barrier, it can be determined that a front edge of the note of value, as viewed in the separating direction, reaches the gap, wherein the transport element is immediately stopped as soon as the front edge of the note of value reaches the gap. This prevents that further notes of value are withdrawn and ensures that a preset distance between notes of value consecutively transported in the separating direction is given.

In a preferred embodiment of the invention, the transport element is stopped when by means of the sensor unit it has been detected that a plurality of notes of value jointly has been withdrawn as a multiple withdrawal. This prevents the notes of value of the multiple withdrawal from being transported further in the separating direction.

In this case, additionally or alternatively the counter run element can be driven such that it transports at least the note of value of the multiple withdrawal that is contacted by the counter run element back in the direction of the stack of notes of value. Herein, the counter run element transports this note of value opposite the separating direction. To this end, the counter run element is particularly driven in the separating rotational direction such that, due to the arrangement of the counter run element and the transport element on opposing sides of the transport path, it transports the note of value opposite to the separating rotational direction.

To this end, the counter run element is particularly driven until the sensor unit detects that only exactly one note of value remains present in the monitoring position such that all of the notes of value except for one are transported back by means of the counter run element and such that as planned only one note of value can be transported further in the separating direction in the direction of the further transport elements. To this end, after exactly one note of value has been detected to be remaining by the sensor unit and after all other notes of value have been transported back, the transport element is again driven such that it transports the remaining note of value further in the separating direction.

In a particularly preferred embodiment of the invention, after the sensor unit has detected that only exactly one note of value is still present, the counter run element is still driven until the front edge, as viewed in the separating direction, of the note of value of the multiple withdrawal last transported back is arranged within the separating gap or upstream of the separating gap.

After all but one of the notes of value of the multiple withdrawal have been transported back, the procedure for transporting the remaining note of value in the separating direction particularly continues such as described before with regard to the withdrawal of only exactly one note of value.

The note of value or the notes of value that have been transported back are subsequently again withdrawn according to the procedure described above and are thus also transported individually in the separating direction.

As viewed in an axial direction of the shafts on which they are arranged, the rollers of the transport element and the rollers of the counter run element are arranged offset relative to one another. If by means of the sensor unit it has been determined that a plurality of notes of value jointly have been withdrawn as a multiple withdrawal, the distance between the shaft of the transport element and the shaft of the counter run element can be reduced. Such, the overlap of the rollers of the transport element and the rollers of the counter run element is enlarged such that a greater force is exerted onto the notes of value arranged in the separating gap such that the force that at least transports back the note of value contacting the counter run element is increased. Thus it is ensured that in fact only one note of value is transported further in the direction of the further transport element and that all other notes of value of the multiple withdrawal are retained. The term overlap in respect to the rollers of the transport element and the rollers of the counter run element in particular means that the projection of the rollers of the transport element in one plane, whose normal vector is directed towards an axial direction of the shaft of the transport element and thus towards an axial direction of the shaft of the counter run element, and the projection of the rollers of the counter run element in this plane partially overlap.

In a preferred embodiment of the invention, if by means of the sensor it has been determined that, despite the corresponding drive of the withdrawal element and/or the transport element, no note of value has been transported into the monitoring position, the counter run element, the transport element and the withdrawal element are respectively driven in the direction into which they would respectively transport one note of value in the separating direction. Thus, it is achieved that, even if the note of value contacting the withdrawal element sticks to other notes of value of the stack of notes of value, this note of value is withdrawn in the separating direction due to the joint drive of the transport element, the withdrawal element and the counter run element in the separating direction owing to the strong force thus applied to it.

In the above-described arrangement of the counter run element, the withdrawal element and the transport element on the different sides of the transport path, to this end, particularly the transport element and the withdrawal element are rotated in the separating rotational direction, whereas the counter run element is rotated opposite to this separating rotational direction.

Further, it is advantageous that, after the sensor unit has detected that erroneously no note of value has been withdrawn, the counter run element and the withdrawal element are driven until the sensor unit detects the presence of at least one note of value, and that the counter run element and the withdrawal element are subsequently stopped. Herein, the determination of the presence of at least one note of value by means of the sensor unit may be effected continuously and/or at preset time intervals.

Additionally or alternatively, if it has been detected that no note of value has been withdrawn, the distance between the shaft of the transport element and the shaft of the counter run element may be increased such that the overlap of the rollers of the transport element and the counter run element is reduced while the force required for withdrawing the note of value from the stack of notes of value is reduced.

Further, by means of a further sensor, it can be determined whether the stack of notes of value is arranged in the separating position. Depending on the signal of such sensor and/or on the data generated by such sensor, in particular a transport unit is controlled so as to transport a stack of notes of value from an input and/or an output unit to the separating position. Thus it is ensured that the stack of notes of value is in fact arranged in the separating position such that in accordance with the method described above a safe withdrawal and separation of the notes of value is possible. The transport unit particularly comprises an upper and a lower transport unit between which the stack of notes of value is transported, wherein the upper and the lower transport unit herein press upon the stack of notes of value such that a safe transport is achieved. If the stack is arranged in the separating position, the force with which the upper transport unit presses upon the stack of notes of value can be reduced such that the notes of value are more easily withdrawable.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention will become apparent from the following description which outlines the invention by means of embodiments with reference to the accompanying drawings.

The drawings comprise:

Figure 1:
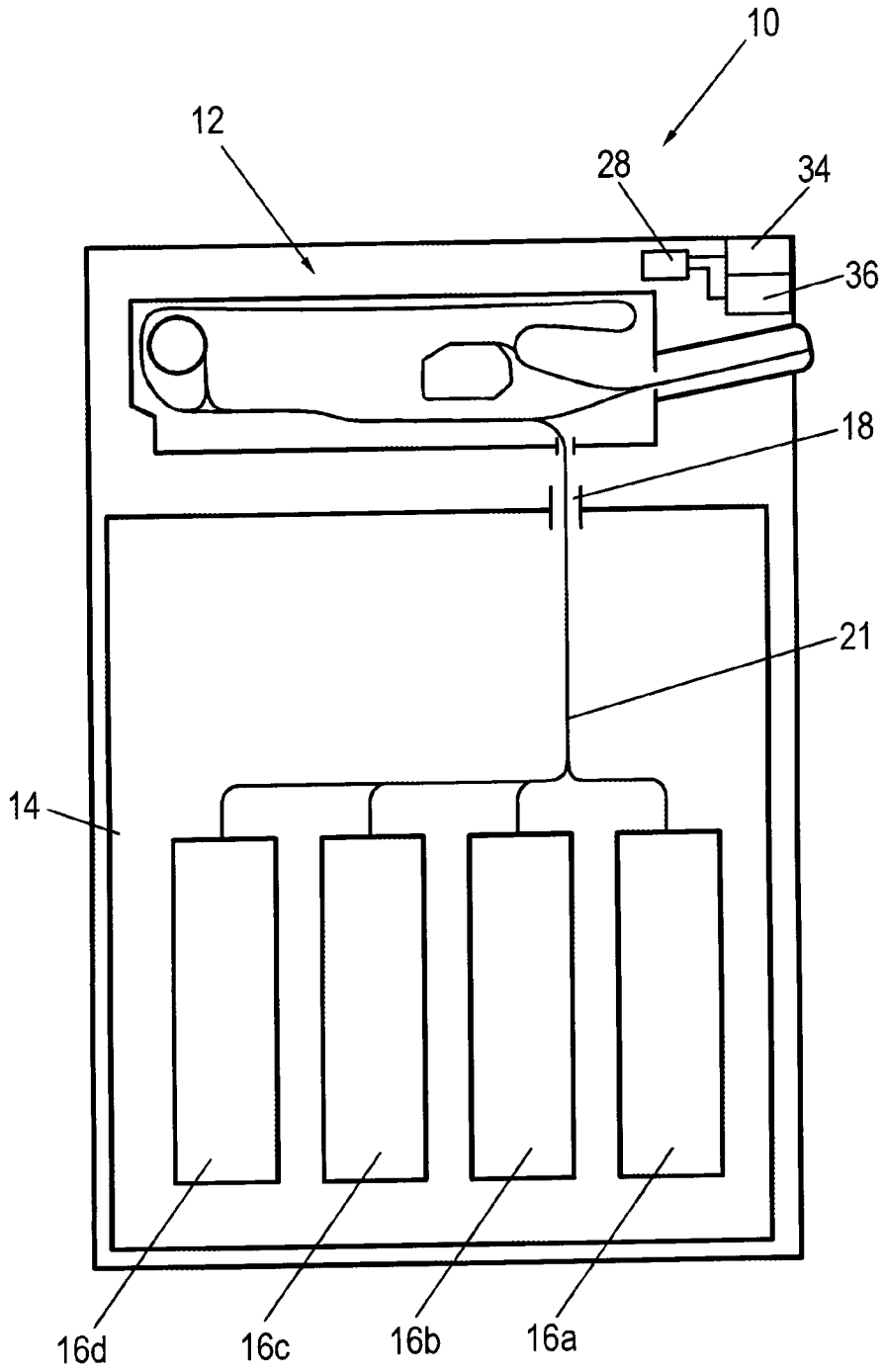
Figure 2:
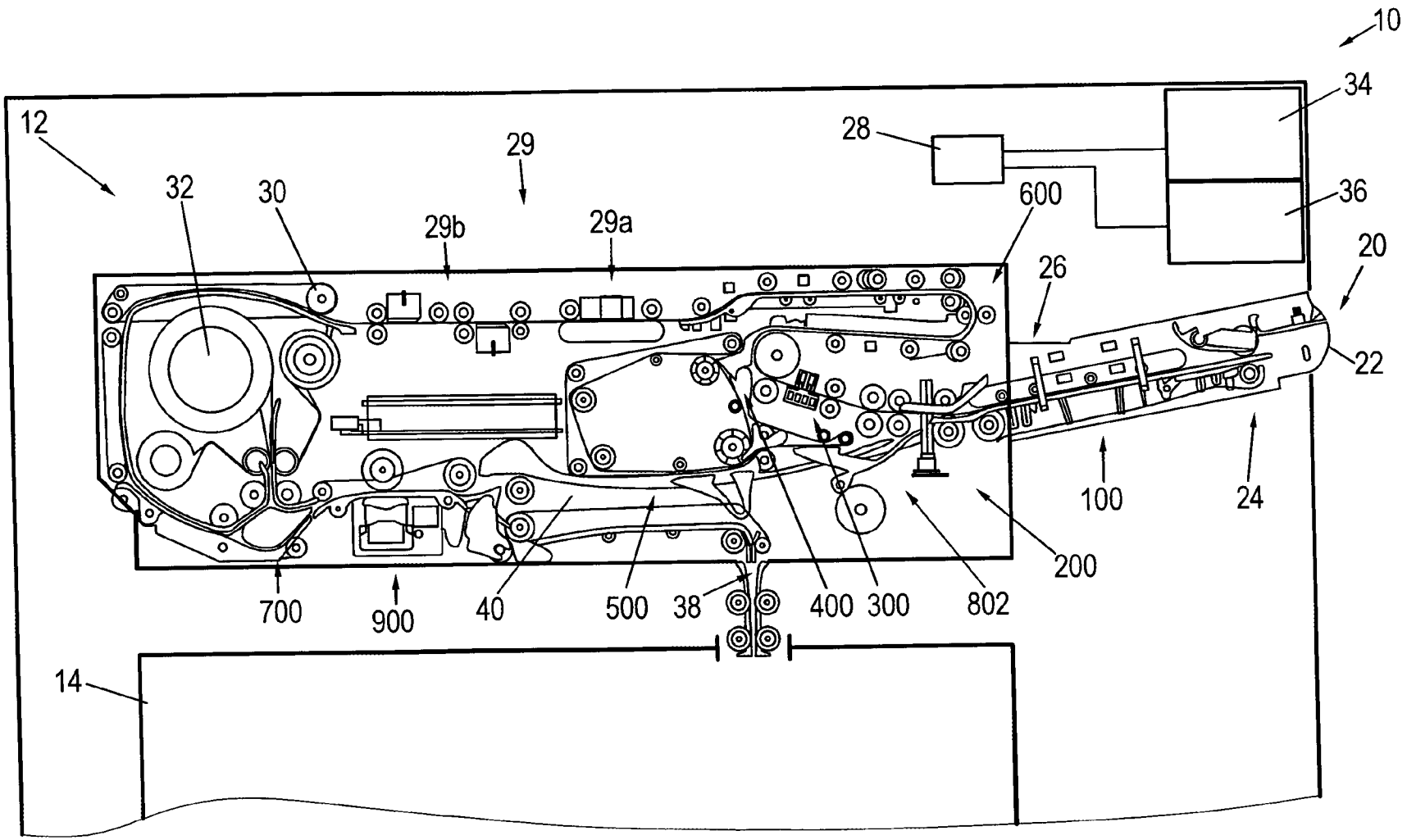
Figure 3:
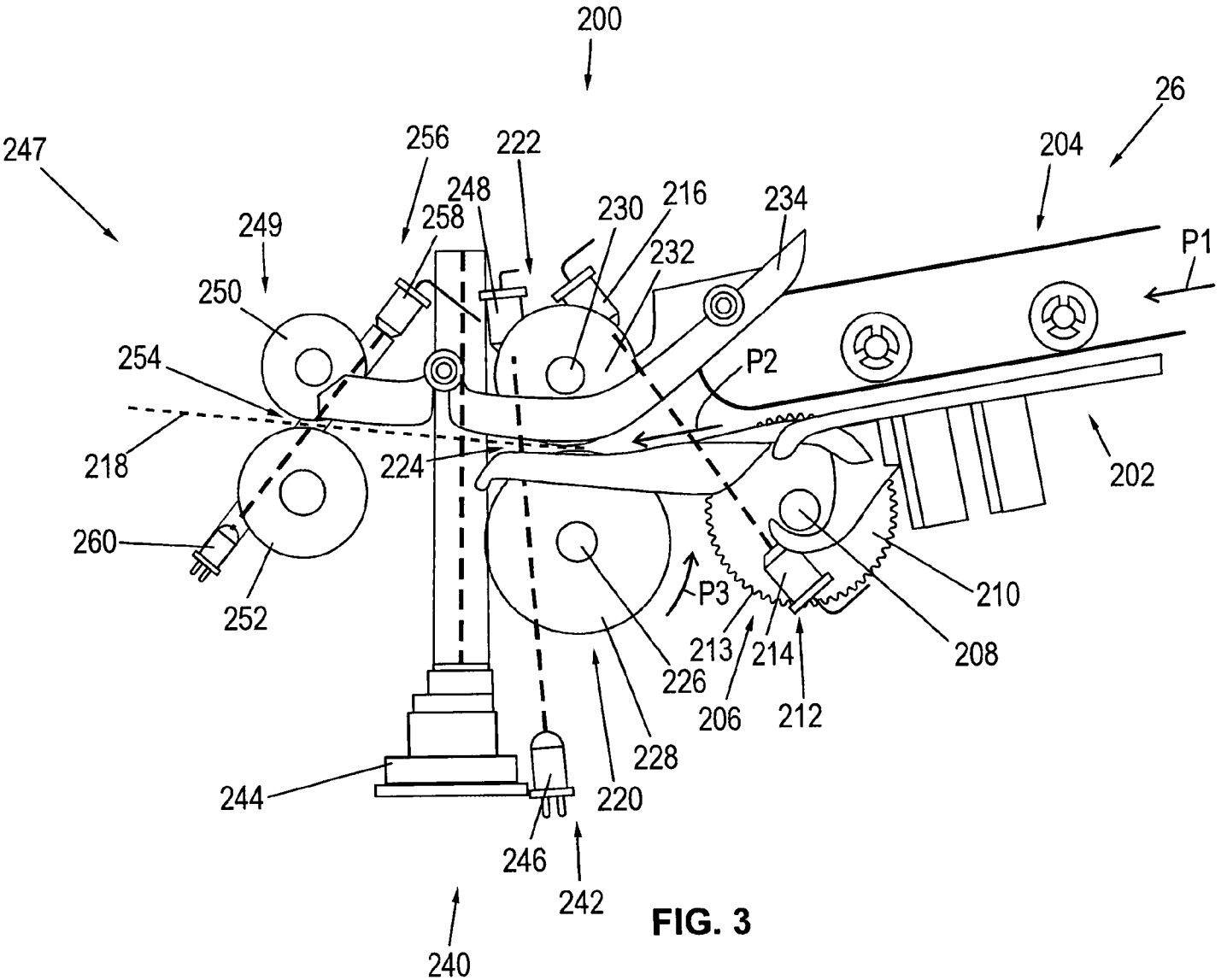
Figure 4:
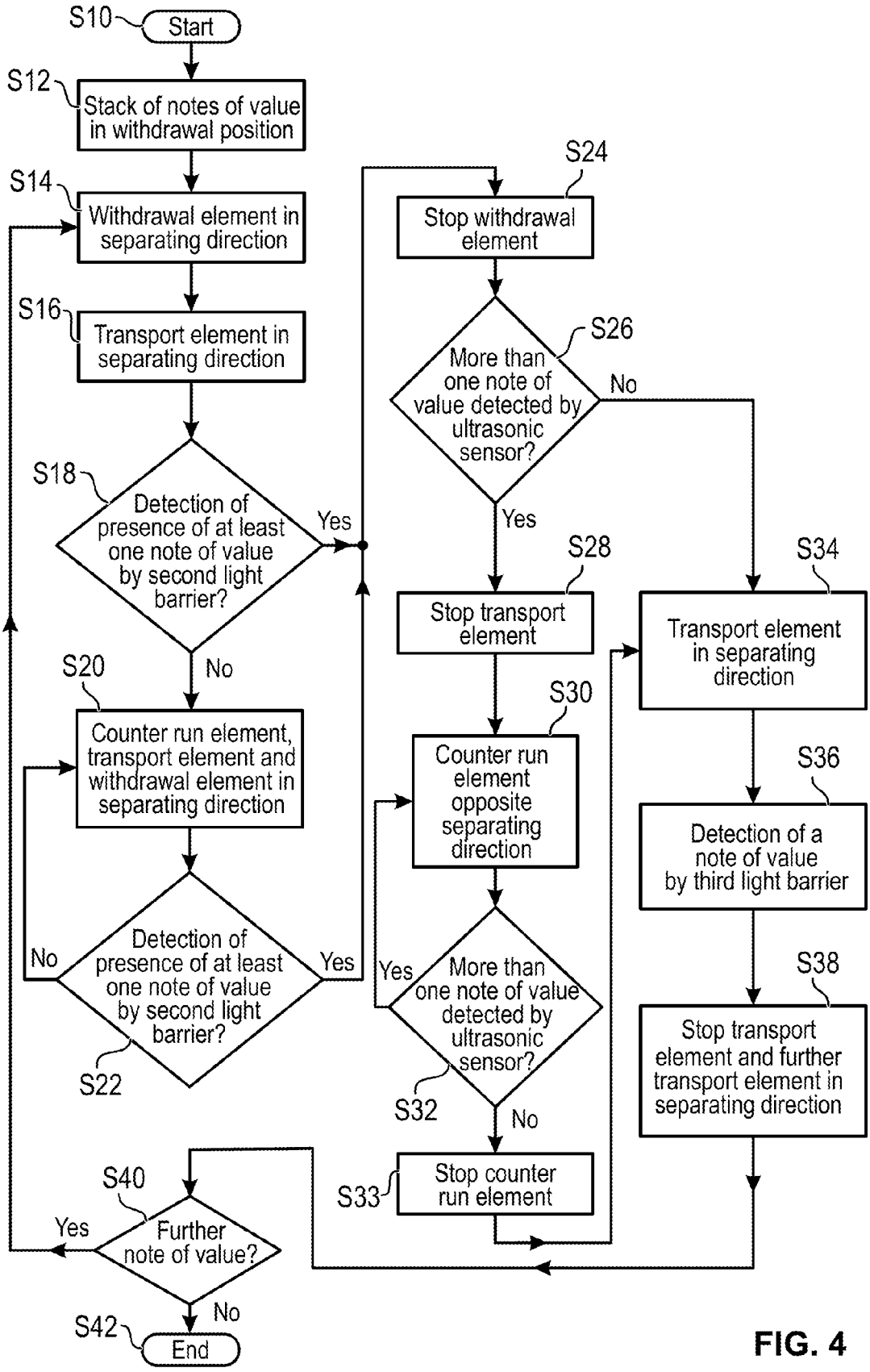

FIG. 1 showing a schematic view of a device for handling notes of value;

FIG. 2 showing a schematic view of a head module of the device according to FIG. 1;

FIG. 3 showing a schematic view of a separating unit of the device according to FIGS. 1 and 2; and FIG. 4 illustrating a flowchart of the method for separating notes of value of a stack of notes of value by means of the separating unit according to FIG. 3.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

FIG. 1 is a schematic view of a device 10 for handling notes of value. The device 10 particularly is an automatic cash safe, an automatic cash system and/or an automated teller machine, such as a cash deposit machine for depositing banknotes and checks.

The device 10 comprises a head module 12 and a safe 14. The structure of the head module 12 is described in more detail in connection with FIG. 2. Within the safe 14, four value note cassettes 16*a* to 16*d* are arranged in which the notes of value can be received. Herein, in particular one of the value note cassettes 16*a* to 16*d* is provided for receiving checks whereas the other three value note cassettes 16*a* to 16*d* are provided for receiving banknotes. The reception of banknotes is particularly effected such that these are of a single variety, i.e. such that in every one value note cassette 16*a* to 16*d* exclusively banknotes of an identical denomination are received. Alternatively the reception can be effected as a mixed storage, i.e. that in one value note cassette 16*a* to 16*d* notes of value of different denominations are miscellaneously received. In an alternative embodiment, in the safe 14, more than four or less than four, in particular two, value note cassettes 16*a* to 16*d* can also be provided. In particular, a so-called reject cassette can be provided, in which notes of value are received that are suspect of being counterfeit and/or are damaged. In a preferred embodiment, two value note cassettes 16*a* to 16*d*, namely one for receiving checks and one for receiving banknotes, are provided.

Herein, the notes of value can either be received in the value note cassettes 16*a* to 16*d* in a value note receiving region in a stacked form or be stored between two film tapes wound up on a roller storage. Use can also be made of different types of value note cassettes within the safe 14.

In the present embodiment, the device 10 is formed to be a mere deposit device for merely receiving notes of value. Alternatively it can also be formed to be a recycling device into which notes of value can be both entered and dispensed again.

The safe 14 has a transfer slot 18 through which the notes of value are supplied to the safe 14 from the head module 12. From the transfer slot 18, the notes of value are transported to the value note cassettes 16*a* to 16*d* via a transport unit identified with reference sign 21.

FIG. 2 is a schematic view of the head module 12 according to FIG. 1. The head module 12 has an input and output unit 20 via which the notes of value are entered in the form of a stack of notes of value. Further, this input and output unit 20 may serve to re-dispense individual notes of value and/or stacks of notes of value to the operator of the device 10. The input and output unit 20 in particular has a so-called shutter 22 via which an opening for supplying and dispensing the notes of value can be opened and shut.

By means of a transport unit 24, a stack of notes of value entered via the input and output unit 20 is transported to a first alignment unit 100. By means of the first alignment unit 100, the notes of value of the stack of notes of value are aligned to have a preset orientation or at least the orientation of a portion of the notes of value of the stack of notes of value is changed such that it approximates the preset orientation By means of a transport unit 26, the aligned stack of notes of value is supplied to a separating unit 200 that separates the notes of value of the stack of notes of value and supplies the separated notes of value to a first sensor unit 300.

The first sensor unit 300 comprises an image capturing unit by means of which at least one image with a representation of this note of value is taken of each supplied note of value. Dependent on the representation of the note of value in the image, a control unit 28 of the device 10 determines at least one feature of the note of value and, dependent on this feature, classifies the note of value into checks, banknotes of a preset currency and other sheet-shaped media. Other sheet-shaped media can for example be notes of value of a currency differing from the preset currency and/or other sheet-shaped media erroneously entered by the operator of the device. For example such media can be business cards or account statements. The preset currency in particular is such currency which is to be handled by the device 10 and particularly to be received in the value note cassettes 16*a* to 16*d*.

Those notes of value that are classified to be neither checks nor banknotes of the preset currency are transported via a sorting gate 400 into a second intermediate storage 500 for intermediate storage of sheet-shaped media to there be intermediately stored preferably as a second stack of notes of value. On the other hand, the checks and banknotes of the preset currency are supplied to a second alignment unit 600 via sorting gate 400. By means of this second alignment unit 600, the checks are aligned to have a first preset nominal orientation and the banknotes are aligned to have a second nominal orientation differing from the first nominal orientation. In particular, a plurality of different nominal orientations is preset for banknotes having different denominations and the second alignment unit 600 aligns the notes of value in differing preset nominal orientations not only depending on whether they are checks or banknotes but additionally also depending on the denomination of the banknotes.

The aligned notes of value are subsequently supplied to a second sensor unit 29 by means of which the authenticity of the banknotes is determined and by means of which the magnetic information of the checks is read out. The sensor unit 29 comprises a banknote sensor unit 29*a*, by means of which the authenticity of the banknotes is verified, and a check sensor unit 29*b*, by means of which the authenticity of the checks is verified and the information printed onto the checks is read out. Together with the control unit 28, the first sensor unit 300 and the second sensor unit 29 in particular form a non-counterfeit money and check detection module. Upon determination of the authenticity of the banknotes and/or checks, preferably also information determined by the sensor unit 300 is taken into account.

Subsequently, the notes of value are transported in the direction of a second sorting gate 700 by means of further transport elements, one of which by way of example is referred to by reference numeral 30. Via the second sorting gate 700, all notes of value of the stack of notes of value previously entered, which have been classified to be checks or banknotes of the preset currency, a priori are supplied to a first intermediate storage 32 and are intermediately stored therein. The intermediate storage 32 is particularly formed to be a roller storage, in which the notes of value to be contained are received wound up between two film tapes. After all of the notes of value of the entered stack of notes of value have been received in the first intermediate storage 32 or the second intermediate storage 500, via a display unit 34 at least one piece of information about the notes of value received in the first intermediate storage 32 and/or the second intermediate storage 500 is delivered to the operator. This information in particular comprises information about the number of notes of value entered and/or about the value of the amount of the denominations of the entered notes of value that are received in the first intermediate storage 32. Further, the operator is particularly requested to enter a confirmation information via an input unit 36.

If no confirmation information is input via the input unit 36 by the operator within a preset time interval after request and/or if the user makes a negative input, then the notes of value contained in the first intermediate storage 32 are transported away from this storage and are supplied to a stacking unit 40, by means of which a first stack of notes of value is formed out of all notes of value contained in the first intermediate storage 32. Further, the second stack of notes of value contained in the second intermediate storage 500 is taken out of the second intermediate storage 500. Both the first stack of notes of value and the second stack of notes of value are supplied to a stack combining unit 802 by means of which one single combined stack of notes of value is formed out of the first and the second stack of notes of value. This combined stack of notes of value is subsequently re-dispensed to the operator via the input and output unit 20.

If, on the other hand, the user inputs the confirmation information within the preset time interval after the respective request, then the second stack of notes of value is removed from the second intermediate storage 500 and is delivered to an operator via the input and output unit 20.

On the contrary, the notes of value intermediately stored in the first intermediate storage 32 are supplied along a transport path 38 to the safe 14 and are received in the value note cassettes 16*a* to 16*d*. The checks intermediately stored in the first intermediate storage 32 are voided in a predetermined printing area of the check by printing a void printing image thereupon prior to transport of the checks to the safe 40. To this end, a printing unit 900 for imprinting the checks is provided between the second sorting gate 700 and the transport path 38. Herein, via the sorting gate 700, the checks are supplied to the printing unit 900 in such a way that the printing area, onto which the void information is be printed, is oriented towards the print head of the printing unit 900 such that this print head is able to print the void printing image onto this printing area.

The head module 12 described earlier is used to achieve that in a device 10 checks and banknotes can be handled jointly and can be supplied to the device 10 even though arbitrarily mixed in a stack. This results in a particularly high user comfort for the operator of the device 10, who therefore does neither have to effect any manual pre-sorting of the notes of value into checks and banknotes nor any presetting, as applicable to known devices, as to the kind of notes of value.

FIG. 3 is a schematic view of the separating unit 200. The transport unit 26 comprises a lower transport module 202 and an upper transport module 204. After alignment in the first alignment station 100, the stack of notes of value entered via the input and output unit 20 is transported via the transport unit 26 in a transport direction, suggested by arrow P1 in FIG. 3. Herein, the stack of notes of value is supported by the lower transport module 202 and the upper transport module 204 presses onto the stack of notes of value from the side opposing the supported side of the stack of notes of value such that the stack of notes of value is safely transported into transport direction P1 owing to the cooperation of the lower and the upper transport module 202, 204. The upper transport module 204 and the lower transport module 202 comprise a plurality of rollers and/or belts contacting the stack of notes of value and transporting it in direction P1 via the contact.

The transport unit 26 transports the stack of notes of value into direction P1 until it becomes arranged in a separating position, in which a withdrawal element 206 contacts the note of value of the stack of notes of value supported by the lower transport unit 26. The withdrawal element 206 comprises a shaft 208 driveable by means of a drive unit, onto which shaft a plurality of rollers is non-rotatably mounted, wherein FIG. 3 shows only one of these rollers referred to by reference numeral 210. On the peripheral surface of the roller 210 teeth 213 are provided such that a greater force can be transferred from the roller 210 to the stack of notes of value in contact therewith.

Further, the separating unit 200 has a first light barrier 212, whereof FIG. 3 merely shows an emitting diode 214 and a receiver diode 216. By means of this first light barrier 212, it can be determined whether a stack of notes of value is arranged in the separating position.

For withdrawal and separation of a note of value from the stack of notes of value, the withdrawal element 206 is driven such that it transports the note of value of the stack of notes of value that is in contact with it in a separating direction P2. To this end, the withdrawal element 206 is driven in a separating rotational direction P3 via a drive unit not illustrated.

The transport path, along which the notes of value are transported within the separating unit 200, is suggested by broken line 218.

Downstream of the withdrawal element 206, a transport element 220 and a counter run element 222 are arranged, wherein between those two elements a separating gap 224 is formed, through which the notes of value to be separated are transported. The transport element 220 comprises a shaft 226 driveable via a drive unit as well as a plurality of rollers 228 non-rotatably connected therewith. Also the counter run element 222 comprises a driveable shaft 230 and a plurality of rollers 232 non-rotatably connected therewith.

The withdrawal element 206, the transport element 220 and the counter run element 222 are in particular driven via a common central drive unit. Also further transport elements to be described below are preferably also driven by means of this central drive unit. In an alternative embodiment of the invention, various drive units may be provided for driving the different elements 206, 220, 222. These drive units or the central drive unit, respectively, in particular comprise an electric motor.

As viewed in an axial direction of the shafts 226, 230, the rollers 228 of the transport element 220 and the rollers 232 of the counter run element 222 are arranged offset relative to one another. The shafts 226, 230 are displaceable and/or pivotable relative to one another such that the distance between the shafts 226, 230 can be varied. Consequently, the overlap of rollers 228, 232 can be set which means that also the force exerted onto the note of value arranged in the separating gap 224 can be varied.

Further, a plurality of guiding elements 234, 236 is provided guiding the notes of value when transported along the transport path 218 and at least section-wise limiting the transport path 218.

Downstream of the separating gap 224, a sensor unit 240 is provided comprising a second light barrier 242 and an ultrasonic sensor 244. By means of the second light barrier 242, again merely shown in a simplified way in the form of emitting diode 246 and receiver diode 248, it can be determined whether at least one note of value has been transported through the separating gap 224. By means of the ultrasonic sensor 244 it can then be determined whether only exactly one note of value has been transported through the separating gap or whether a plurality of at least partially overlapping notes of value, a so-called multiple withdrawal, has been transported through the separating gap 224.

The determination whether one note of value or a plurality of notes of value has been withdrawn is effected by the detection of air trapped between the notes of value of a potential multiple withdrawal by means of an ultrasonic sensor. Alternatively or additionally also the thickness of the multiple withdrawal can be determined by means of the ultrasonic sensor 244.

In an alternative embodiment of the invention, no light barrier 242 but only the ultrasonic sensor 244 can be provided. In this embodiment, both the determination whether one note of value has been withdrawn at all and the determination whether, in the case of a value note withdrawal being present, one or a plurality of notes of value have been withdrawn is effected by the ultrasonic sensor 244. Alternatively, also a sensor different from an ultrasonic sensor 244 can be used for determining the number of notes of value withdrawn.

Downstream of the sensor unit 240, a further transport element 247 is provided comprising a plurality of roller pairs, only one of which is shown in FIG. 3 and referred to by reference numeral 249. The pair of rollers 249 comprises two rollers 250, 252, between which a gap 254 is formed, through which a note of value transported along transport path 218 in separating direction P2 is transported.

At least one of the two rollers 250, 252 of the pair of rollers 249 is driveable such that when driving this at least one driveable roller 250, 252, a note of value arranged in the gap 254 can be transported in separating direction P2.

By means of a third light barrier 256, again merely shown in a simplified way in the form of emitting diode 258 and receiver diode 260, it can be determined whether at least one note of value is arranged in the gap 254. The sensor signal of the third light barrier 256 in particular is used for controlling the further transport element 247 of the transport element 220 and the withdrawal element 212.

FIG. 4 is a flowchart of a method for separating the notes of value of a stack of notes of value. The procedure starts in step S10. Subsequently, in step S12 the stack of notes of value is transported into the separating position by means of transport unit 26. After the light barrier 212 has detected the presence of the stack of notes of value in the separating position, the withdrawal element 206 is driven such in step S14 that it transports the note of value being in contact with it in separating direction P2. To this end, withdrawal element 206 is rotated in the separating rotational direction P3.

After the at least one note of value withdrawn from the stack of notes of value by means of the withdrawal element has been transported into separating gap 224, in step S16, the transport element 220 is driven such that it also transports the note of value being in contact with it in separating direction P2. To this end, also transport element 220 is rotated in the separating rotational direction P3. By means of the second light barrier 242, the presence of at least one note of value is monitored shortly behind the separating gap 224. If, in spite of the withdrawal element 206 and/or the transport element 220 being driven, no note of value is detected by the second light barrier 242 after a preset time interval, it is concluded therefrom in step S18 that a so-called faulty withdrawal has occurred. A faulty withdrawal means that no note of value is withdrawn even though this was intended.

In the case of such faulty withdrawal, the counter run element is driven such in step S20 that it also transports one note of value, if it is in contact with one, in separating direction P2. To this end, the counter run element 222 is driven opposite the separating rotational direction P3. The transport element and the withdrawal element 206 are also driven further in the separating rotational direction such that they also transport a note of value in contact with them in the separating direction P2.

By means of the second light barrier 242, further the presence of a note of value in its detection area is detected. Herein, the detection can be effected continuously or at preset time intervals. If the second light barrier 242 determines in step S22 that at least one note of value is present in its detection area, the procedure is continued in step S24 and the withdrawal element 206 is stopped such that it does not withdraw any further note of value of the stack of notes of value.

If, however in step S22 still no note of value is detected to be present in the detection area of the second light barrier 242, the counter run element 222, the transport element 220 and the withdrawal element 206 are consequently further driven such that they would transport a note of value in contact therewith in separating direction P2. This procedure continues until at least one note of value has been withdrawn from the stack of notes of value. Alternatively, a period of time may also have been preset, after expiration of which the procedure is discontinued and a notice of error is put out.

In an alternative embodiment of the invention, in step S20 additionally also the distance of shafts 226 and 230 relative to one another can be increased such that a note of value of the stack of notes of value can enter the separating gap more easily as the retention forces exerted are reduced.

If however, already in step S18 it has been detected that at least one note of value is arranged in the detection area of the second light barrier 242, the withdrawal element 206 is stopped by branching to step S24. Subsequently in step S26, it is determined by means of the ultrasonic sensor 244 whether exactly one note of value has been withdrawn or whether a plurality of notes of value that overlap each other have been withdrawn in the form of a multiple withdrawal. If in step S26 it has been determined that a multiple withdrawal has occurred, the transport element 220 is stopped in step S28 and the counter run element 222 is thus driven in step S30 that it transports at least the note of value being in contact with it opposite to the separating direction P2. To this end, the counter run element 222 is rotated into separating direction P3. Stopping the transport element 220 and driving the counter run element 222 can preferably also be simultaneously effected in one common step.

In step S32 it is determined continuously or at preset time intervals by means of the ultrasonic sensor 244 whether still more than one note of value or exactly one note of value is arranged in the detection area of the ultrasonic sensor 244. The counter run element 222 is driven opposite the separating rotational direction P3 until the ultrasonic sensor 244 detects only the presence of exactly one note of value in its detection area and until the note of value having last been transported back by the counter run element 222 is arranged in the separating gap 224 or upstream of the separating gap 224 with its front edge as viewed in separating direction P3. Subsequently, in step S33, the counter run element 222 is stopped and in step S34, the transport element 220 is again driven such that it transports the remaining note of value of the multiple withdrawal further in separating direction P2. To this end, the transport element 220 is again driven in the separating rotational direction P3.

If, already in step S26, it has been determined that only one note of value has been withdrawn as intended, the procedure continues directly at step S34 and the transport element 220 is driven further in separating rotational direction P3. After in step S36, the presence of the withdrawn note of value has been detected in the detection area of the third light barrier 256 and thus in the gap 254 of the further transport element 247, the transport element 220 is stopped in step S38 and the further transport element is driven such that it transports the note of value arranged in the gap 254 further in separating direction P2. By immediately stopping the transport element 220 it is achieved that the notes of value of the stack of notes of value arranged in the separating position are retained by the transport element 220 in cooperation with the counter run element 222 also standing still, such that it is prevented that a further note of value subsequently slips in. Thus it is ensured that a preset minimum distance between two notes of value successively transported along the transport path 218 is adhered to and that the notes of value can by reliably handled in the further handling in the device 10. Consequently, it is prevented that so-called flags occur.

While notes of value of the multiple withdrawal are transported back, the distance between the shafts 226, 230 can be reduced, such that the rollers 228, 232 overlap to a greater extent resulting in a greater force being exerted upon the notes of value of the stack of notes of value arranged in the separating gap 224, resulting in an also increased feedback force exerted upon the note of value contacted by the counter run element 222.

Subsequently, in step S40, it is determined by means of the first light barrier 212 whether still at least one note of value is arranged in the separating position. If this is applicable, the procedure continues at step S14. If, however, it is determined in step S40 that already all notes of value of the stack of notes of value individually have been transported away in separating direction P2 along transport path 218, the procedure is terminated in step S42.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A method for separating a stack of notes of value, comprising:

wherein the stack of notes of value is arranged in a separating position, wherein a withdrawal element is driven such that it transports at least one note of value of the stack of notes of value being in contact with the withdrawal element in a separating direction in the direction of a separating gap formed between a transport element and a counter run element, wherein, when the note of value reaches the separating gap, the transport element is driven such that it transports the note of value further in the separating direction, wherein by means of a sensor unit arranged downstream of the separating gap at a monitoring position, the number of the notes of value withdrawn and transported through the separating gap is determined, wherein the withdrawal element, the transport element and/or the counter run element are controlled depending on the number determined, wherein if by means of the sensor unit it has been determined that a plurality of notes of value jointly have been withdrawn as a multiple withdrawal, the counter run element is driven such that it transports all but one note of value of the multiple withdrawal, which is contacted by the counter run element, back in the direction of the stack of notes of value;

wherein the counter run element is driven until the sensor unit detects that only exactly one note of value is still present at the monitoring position, and until the front edge, as viewed in the separating direction, of a note of value of the multiple withdrawal last transported back is arranged within the separating gap, and in that subsequently, the transport element is again driven such that it transports a remaining note of value further in the separating direction; and wherein the counter run element is not driven at least until the front edge, as viewed in the separating direction, of the note of value withdrawn has reached the monitoring position.

2. The method according to claim 1, wherein the notes of value are transported along a transport path while the procedural steps are carried out, in that the withdrawal element and the transport element are arranged on a first side of the transport path and, for transport of the notes of value in the separating direction are rotated in a separating rotational direction, and in that the counter run element is arranged on a second side opposing the first side.

3. The method according to claim 1, wherein the withdrawal element, the transport element and/or the counter run element each have a driveable shaft and a plurality of rollers non-rotatably mounted to this shaft, wherein the rollers contact the notes of value and transport the contacted notes of value when the respective shaft is driven.

4. The method according to claim 3, wherein the rollers of the transport element and the rollers of the counter run element are arranged offset relative to one another in an axial direction of the shafts, and in that, if by means of the sensor unit it has been determined that a plurality of notes of value jointly have been withdrawn in the form of a multiple withdrawal, the distance between the shaft of the transport element and the shaft of the counter run element is reduced.

5. The method according to claim 3, wherein the rollers of the transport element and the rollers of the counter run element are arranged offset relative to one another in an axial direction of the shafts, and in that, if by means of the sensor unit it has been determined that, despite the corresponding drive of the withdrawal element and/or the transport element, no note of value has been transported into the monitoring position, the distance between the shaft of the transport element and the shaft of the counter run element is increased.

6. The method according to claim 1, wherein a sensor unit is used comprising a first sensor, in particular a light barrier, and a second sensor arranged downstream of the first sensor, in particular an ultrasonic sensor, in that by means of the first sensor it is determined whether one or a plurality of notes of value has been withdrawn at all, and in that by means of the second sensor it is determined whether one or more than one note of value has been withdrawn.

7. The method according to claim 6, wherein the withdrawal element is stopped when the first sensor has determined the presence of at least one note of value in its detection area.

8. The method according to claim 1, wherein if by means of the sensor unit it has been determined that a plurality of notes of value jointly have been withdrawn as a multiple withdrawal, the transport element is stopped.

9. The method according to claim 1, wherein if by means of the sensor unit it has been determined that, despite the corresponding drive of the withdrawal element and/or the transport element, no note of value has been transported into the monitoring position, the counter run element, the transport element and the withdrawal element are respectively driven in the direction into which they would respectively transport one note of value in the separating direction.

10. The method according to claim 9, wherein the counter run element and the withdrawal element are driven until the sensor unit detects the presence of at least one note of value and in that the counter run element and the withdrawal element are subsequently stopped.

11. The method according to claim 1, wherein the withdrawal element, the transport element and/or the counter run element each have a driveable shaft and a plurality of rollers non-rotatably mounted to this shaft, wherein the rollers contact the notes of value and transport the contacted notes of value when the respective shaft is driven; and wherein only the roller of the counter run element is rotated in a reverse direction to transport a note of value back in the direction of the stack of notes of value.

12. A method for separating a stack of notes of value, comprising:

wherein the stack of notes of value is arranged in a separating position, wherein a withdrawal element is driven such that it transports at least one note of value of the stack of notes of value being in contact with the withdrawal element in a separating direction in the direction of a separating gap formed between a transport element and a counter run element, wherein, when the note of value reaches the separating gap, the transport element is driven such that it transports the note of value further in the separating direction, wherein by means of a sensor unit arranged downstream of the separating gap at a monitoring position, the number of the notes of value withdrawn and transported through the separating gap is determined, wherein the withdrawal element, the transport element and/or the counter run element are controlled depending on the number determined, wherein if by means of the sensor unit it has been determined that a plurality of notes of value jointly have been withdrawn as a multiple withdrawal, the counter run element is driven such that it transports all but one note of value of the multiple withdrawal, which is contacted by the counter run element, back in the direction of the stack of notes of value;

wherein the counter run element is driven until the sensor unit detects that only exactly one note of value is still present at the monitoring position, and until the front edge, as viewed in the separating direction, of a note of value of the multiple withdrawal last transported back is arranged within the separating gap, and in that subsequently, the transport element is again driven such that it transports a remaining note of value further in the separating direction; and wherein if by means of the sensor unit it has been determined that exactly one note of value has been withdrawn, the transport element is driven such that the transport element transports this note of value in the separating direction in the direction of a further transport element, and that the transport element is stopped when the further transport element contacts the note of value.

13. The method according to claim 12, wherein the further transport element comprises at least two driven rollers, in that the note of value is transported into a gap formed between the rollers, in that the rollers contact the note of value arranged in the gap and transport it in the separating direction, in that by means of a further sensor, in particular a light barrier, it is determined that a front edge of the note of value, as viewed in the separating direction, has reached the gap, and in that, when the front edge has reached the gap, the transport element is immediately stopped.

* * * * *